US007707835B2

(12) United States Patent
Lipinski et al.

(10) Patent No.: US 7,707,835 B2
(45) Date of Patent: May 4, 2010

(54) AXIAL FLOW SLEEVE FOR A TURBINE COMBUSTOR AND METHODS OF INTRODUCING FLOW SLEEVE AIR

(75) Inventors: John Joseph Lipinski, Simpsonville, SC (US); Thomas Edward Johnson, Greer, SC (US); Robert Paul Ziegler, Fort Thomas, KY (US); Mark Stewart Schroder, Hendersonville, NC (US)

(73) Assignee: General Electric Company, Schenectady, NY (US)

( * ) Notice: Subject to any disclaimer, the term of this patent is extended or adjusted under 35 U.S.C. 154(b) by 806 days.

(21) Appl. No.: 11/152,234

(22) Filed: Jun. 15, 2005

(65) Prior Publication Data

US 2006/0283189 A1 Dec. 21, 2006

(51) Int. Cl.
*F02C 1/00* (2006.01)
*F02G 3/00* (2006.01)

(52) U.S. Cl. ..... 60/752; 60/772; 60/758

(58) Field of Classification Search ..... 60/752–760
See application file for complete search history.

(56) References Cited

U.S. PATENT DOCUMENTS 4,211,069 A * 7/1980 Kalbfuss ..... 60/772
4,362,500 A * 12/1982 Eriksson et al. ..... 431/352
4,628,687 A * 12/1986 Strom ..... 60/39.23
4,719,748 A * 1/1988 Davis et al. ..... 60/39.37
4,916,906 A * 4/1990 Vogt ..... 60/757
6,098,397 A * 8/2000 Glezer et al. ..... 60/772
6,412,268 B1 * 7/2002 Cromer et al. ..... 60/772
6,446,438 B1 * 9/2002 Kraft et al. ..... 60/737

* cited by examiner

*Primary Examiner*—Michael Cuff
*Assistant Examiner*—Gerald L Sung
(74) *Attorney, Agent, or Firm*—Nixon & Vanderhye, P.C.

(57) ABSTRACT

A combustor has a flow sleeve and a flow liner defining a generally axial flow direction of compressor discharge air toward combustor burners. A casing is secured to the forward end of the flow sleeve defining an annular plenum along the interior of the flow sleeve. Openings through the flow sleeve supply compressor discharge air into the plenum where the air changes direction for flow through apertures into and generally coaxially with the free air stream. The axial injection minimizes or eliminates energy losses due to cross flow injection within the axial air stream while continuing to cool the liner.

12 Claims, 3 Drawing Sheets

AXIAL FLOW SLEEVE FOR A TURBINE COMBUSTOR AND METHODS OF INTRODUCING FLOW SLEEVE AIR

BACKGROUND OF THE INVENTION

The present invention relates to a gas turbine combustor having a flow sleeve and a liner for supplying compressor discharge air to combustor burners and particularly relates to a casing for turning compressor discharge air flowing radially through holes in the flow sleeve in an axial direction for flow in a generally parallel direction relative to the free stream air in the flow sleeve. The invention also relates to methods for turning the flow.

In current combustors, a plurality of openings are provided about the flow sleeve for injecting air in a generally radial direction into the flow sleeve for impingement cooling the liner. The radially injected air is generally normal to the free stream air flowing within the flow sleeve. It will be appreciated that compressor discharge air flows through openings in the impingement sleeve of a transition piece and forms part of a free stream air flow in an aft direction and between the combustion flow sleeve and liner. This air flow mixes with fuel at the aft end of the combustor and the fuel/air mixture is combusted within the liner. The air injected in the radial direction through the flow sleeve openings and into the free stream has a momentum exchange with the axially flowing air and must be accelerated by the axially flowing free stream air until the cross flowing air reaches the free stream velocity. This process causes a net loss in energy.

In certain combustors, it is desirable to impingement cool the liner of the combustor, necessitating the net loss in energy to cool the liner. In other combustors, however, the magnitude of cooling required to cool the liner is such as to not require impingement cooling flows. Consequently, there is a need to provide a mechanism and a method for reducing energy losses due to cross flow while affording cooling of the liner.

BRIEF DESCRIPTION OF THE INVENTION

In accordance with a preferred aspect of the present invention, the flow sleeve is provided with an inlet which enables the air flowing into the inlet to change direction and enter the free flow stream of compressor discharge air between the liner and flow sleeve in a generally co-flow or coaxial direction, thus eliminating energy losses due to cross flow and accompanying momentum exchange. The inlet includes an annular plenum between the forward end of the flow sleeve and an annular casing about the inside of the flow sleeve. The flow sleeve is provided with a plurality of circumferentially spaced openings for injecting compressor discharge air into the plenum. The casing is provided with a plurality of circumferentially spaced apertures at its aft end for injecting the air from the plenum in a generally axial or co-flow direction with and into the free flow air stream. The inlet thus affords a precise control and metering of the air while simultaneously cooling the liner.

In a preferred embodiment according to the present invention, there is provided a combustor for a gas turbine comprising a combustor housing including a flow liner extending in a generally axial direction and a flow sleeve surrounding and spaced from the flow liner defining a flow path for flowing air in a generally axial direction between the liner and the flow sleeve; and an inlet to the flow sleeve for introducing air into the flow path in substantially the same axial direction as the direction of air flow along the flow path.

In a further preferred embodiment according to the present invention, there is provided a combustor for a gas turbine comprising a combustor housing including a flow liner and a flow sleeve surrounding and spaced from the flow liner defining a flow path therebetween for flowing air generally in a first direction between the liner and the flow sleeve toward one end of the combustor; and an inlet to the flow sleeve for introducing air into the flow path for flow in substantially the first direction and substantially without cross flow between the introduced air and the air flowing along the flow path.

In a further preferred embodiment according to the present invention, there is provided a combustor for a gas turbine having a flow liner, a fuel injector adjacent to one end of the liner and a flow sleeve surrounding and spaced from the liner defining a flow path for flowing air in a direction generally toward the one end, a method of introducing air into the air flowing along the flow path comprising step of injecting air directly into the air flow stream in the general direction toward the one end.

DETAILED DESCRIPTION OF THE INVENTION

Figure 1:
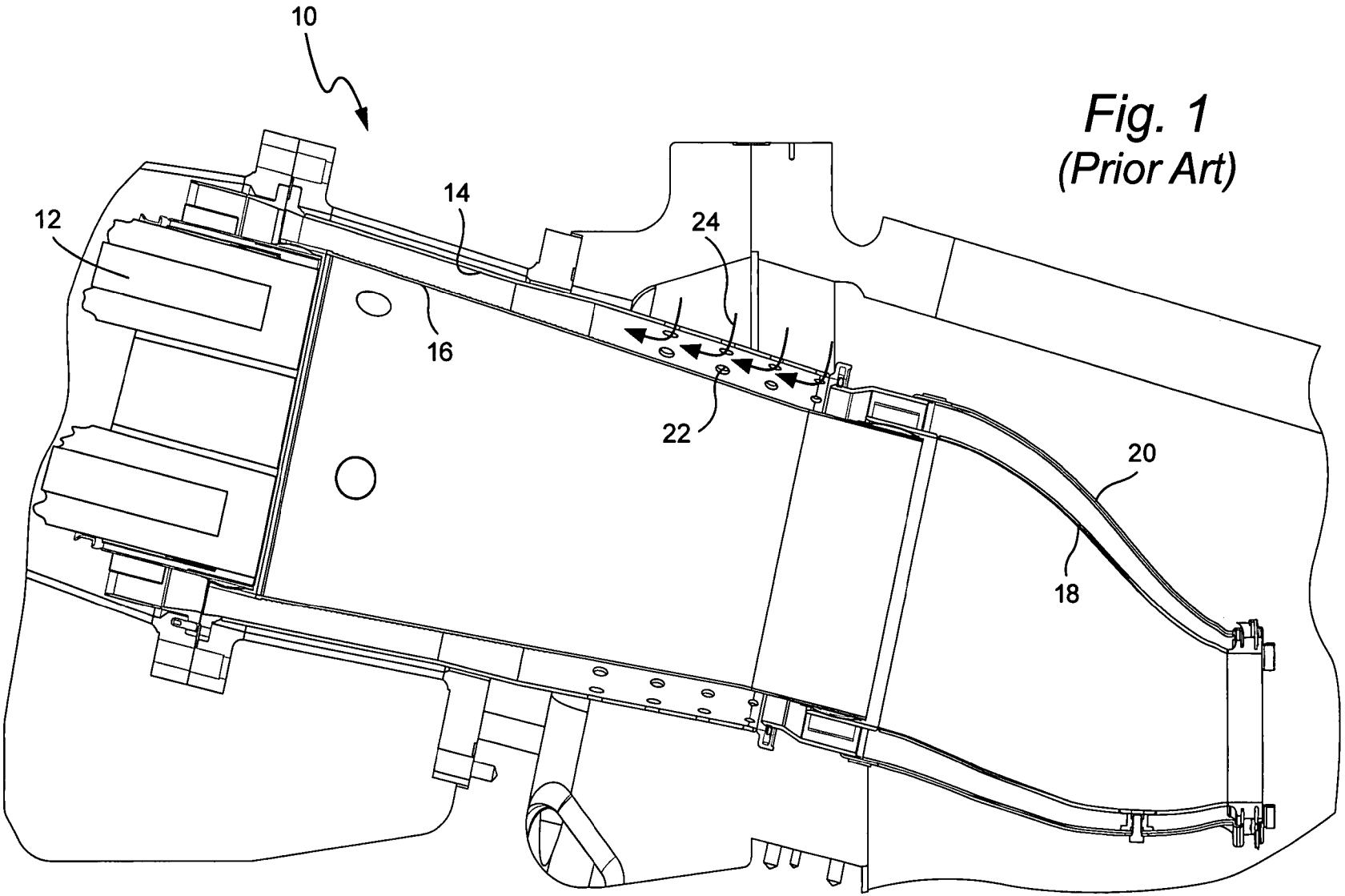
Fig. 1 (Prior Art)
FIG. 1 is a fragmentary cross sectional view of a prior art combustor illustrating the radial inward flow of compressor discharge air into the flow sleeve.

Referring now to the drawing figures, and particularly to FIG. 1, there is illustrated a combustor generally designated 10 according to the prior art. The combustor includes burners 12 at the aft end of the combustor, a flow sleeve 14 and liner 16 and a transition including a transition section piece body 18 and impingement sleeve 20. It will be appreciated that the area surrounding the flow sleeve 14 and the impingement sleeve 20 is supplied with compressor discharge air which in turn flows through openings (not shown) in the impingement sleeve and openings 22 in the flow sleeve for supplying compressor discharge air in a generally axial flow direction aft toward the burner end of the combustor. The supplied air mixes with the fuel in the burners 12, the fuel/air mixture combusts and flows forward within the liner 16. The energetic gases of combustion flow through the transition piece 18 toward the turbine section, not shown, of the gas turbine.

As illustrated in FIG. 1, compressor discharge air indicated by the arrows 24 is supplied through the openings 22 in a generally radially inward direction. Openings 22 are, of course, provided at axially and circumferentially spaced intervals about the flow sleeve 14. Because a portion of the compressor discharge air from between the impingement sleeve 20 and transition piece 18 body flows generally axially aft toward the burner, the air injected radially through openings 22 for impingement cooling purposes, crosses perpendicular to this axially flowing air within the flow sleeve. While the radial impingement of this injected air onto the liner 16 affords impingement cooling, this cross flow results in an appreciable net loss of energy. That is, the axially flowing compressor discharge air in the annular space between the flow sleeve and liner effects a momentum change in the impinging cross flow air which must be accelerated until the cross flow air changes direction and reaches the free stream velocity.

Figure 2:
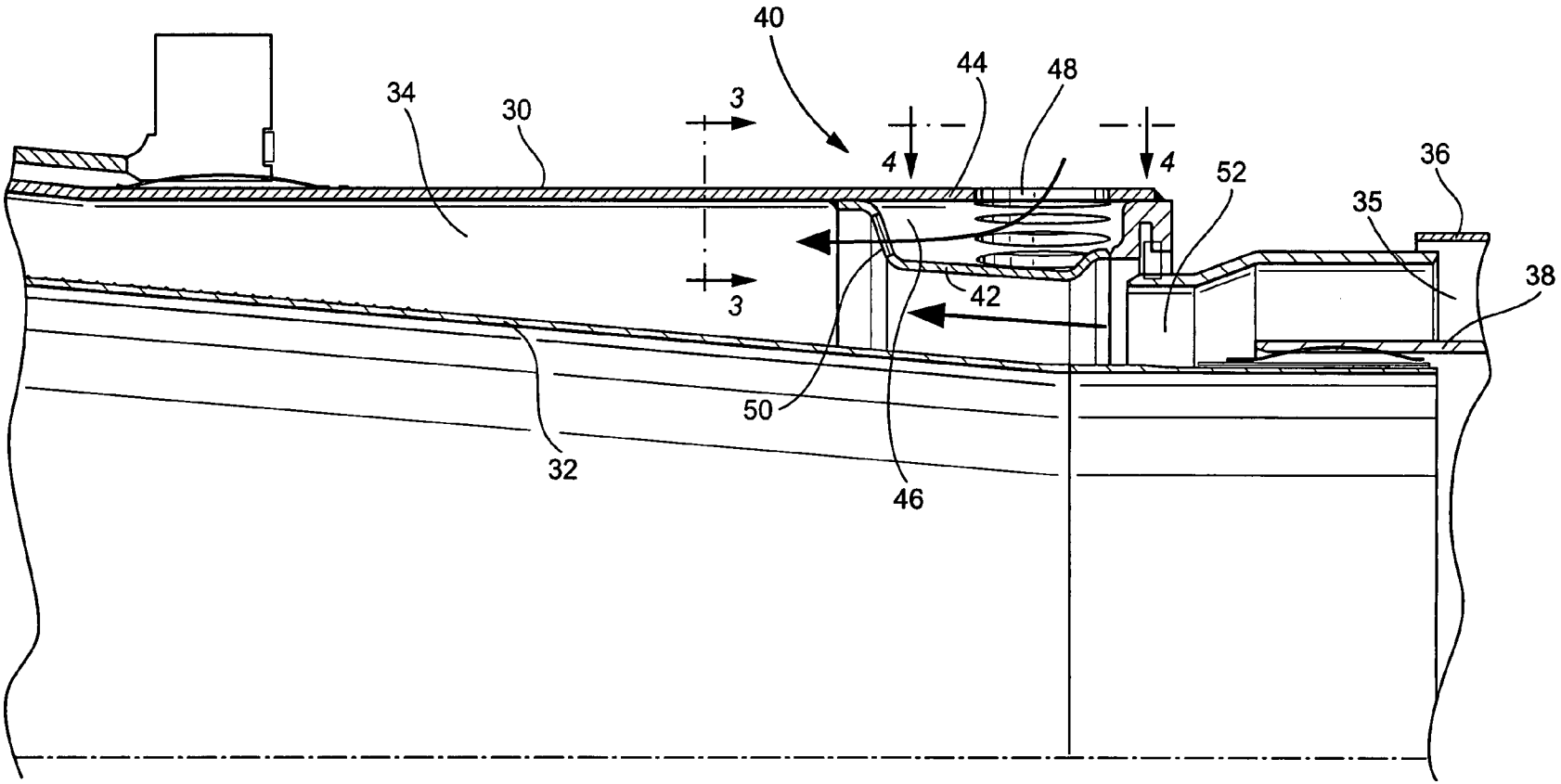
FIG. 2 is an enlarged fragmentary cross sectional view of a portion of the combustor illustrating axial introduction of compressor discharge air into the free flow stream in accordance with a preferred aspect of the present invention.

Referring now to FIG. 2, there is illustrated a portion of an axial flow sleeve in accordance with a preferred aspect of the present invention wherein compressor discharge air is introduced into the axially aft flowing stream within the flow sleeve 30 in a general axial or co-flow direction with the flow stream from the impingement sleeve 36 thereby substantially eliminating or minimizing any net energy loss due to the mixing of these flow streams while simultaneously affording beneficial cooling of the liner. In FIG. 2, there is illustrated a flow sleeve 30 and a liner 32 defining a generally annular axial flow passage 34 for directing compressor discharge air in an aft direction toward the burners. A portion of the compressor discharge air, as in the prior art, is supplied in the passage 35 between the impingement sleeve 36 and transition piece body 38 for flow into the passage 34.

Figure 4:
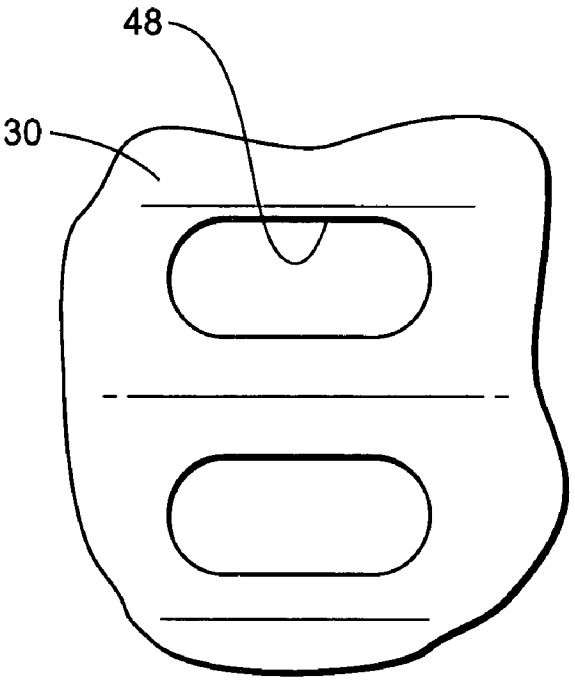
FIG. 4 is an enlarged fragmentary plan view of the openings through the flow sleeve taken generally about on line 4-4 in FIG. 2.
Figure 3:
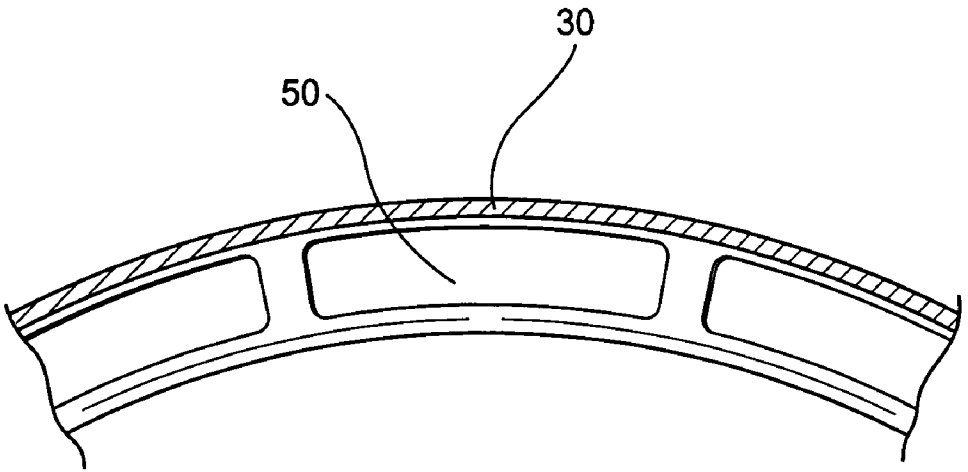
FIG. 3 is a fragmentary enlarged cross sectional view thereof taken generally about line 3-3 in FIG. 2.

To introduce compressor discharge air through the flow sleeve 30 in a generally co-flow direction, there is provided an inlet generally designated 40 including an annular interior casing 42 defining with a portion of the flow sleeve at the forward end a plenum 46. It will be appreciated the casing 42 and plenum 46 extend annularly about the interior surface of the flow sleeve 30. Compressor discharge air is introduced into the plenum 46 through a plurality of circumferentially spaced openings 48 in the forward end of the flow sleeve 30 thereby isolating plenum cavity flow 46 from the flow that is migrating aft from region 35 into region 34. It will be appreciated that additional axial spaced openings 48 may also be provided to supply compressor discharge air to the plenum 46. The air injected through openings 48 is uniquely turned within the plenum by the casing 42 for flow through apertures 50 at the aft end of casing 42. As illustrated in FIG. 4, openings 48 extend axially and are spaced circumferentially from one another. Thus, the flow in the plenum 46 is turned from a radial flow direction through the openings 48 into the plenum to an axial flow direction within the plenum 46 for exit through the apertures 50 into and in a flow direction generally corresponding to the axially flowing free air stream from passage 35 into passage 34. The energy loss previously due to the radial cross flow with the free air stream is minimized or eliminated. Also, there is a positive momentum exchange since the axially injected air flowing through apertures 50 is moving faster than the free stream air flowing from passage 35 into passage 34. This results in an energy addition to the free stream air and a net reduction in combustor pressure drop as compared to prior art. Also, the casing 42 is secured, e.g., by welding or any other variety of metallic joining techniques, along the inside surface of the flow sleeve 30 and radially outward of the exit throat 52. Thus, casing 42 does not interfere physically or pneumatically with the air flow from passage 35 into passage 34.

While the invention has been described in connection with what is presently considered to be the most practical and preferred embodiment, it is to be understood that the invention is not to be limited to the disclosed embodiment, but on the contrary, is intended to cover any number of various modifications and equivalent arrangements included within the spirit and scope of the appended claims.

What is claimed is:

1. A combustor for a gas turbine comprising:

a combustor housing including a flow liner extending in a generally axial direction and a flow sleeve surrounding and spaced from said flow liner, arranged to define a flow path for flowing air in a generally axial flow direction between said liner and said flow sleeve to at least one burner at an aft end of the combustor; and an inlet to said flow sleeve for introducing additional air into the flow path in substantially the same axial direction as the direction of air flow along the flow path wherein said inlet is formed by an annular casing member attached to an inner wall of said flow sleeve within a radially outer portion of said flow path, thereby creating an annular plenum within said flow sleeve, said flow sleeve having at least one radially-oriented hole for flowing the additional air into the plenum in a radial direction substantially perpendicular to said axial flow direction, said casing provided with at least one axially-oriented exit aperture in communication with said plenum wherein said plenum and said axially oriented exit aperture are configured to turn the additional air in said annular plenum from said radial direction to said axial flow direction thereby enabling the additional air to be introduced into the flow path substantially in said axial flow direction and thus preventing radial cross flow of the additional air with the air flowing in said flow path.

2. A combustor according to claim 1 wherein said at least one radially-oriented hole comprises a plurality of holes circumferentially-spaced about said flow sleeve, and further wherein said at least one axially-oriented aperture comprises a plurality of apertures facing in a generally downstream direction of the air flow along the flow path.

3. A combustor according to claim 2 wherein said plenum is also defined in part by a portion of said flow sleeve.

4. A combustor according to claim 2 including an impingement sleeve surrounding a transition piece and defining a passage therebetween for flowing air into a forward end of said flow path, said plenum being spaced outwardly of the air flowing into the flow path.

5. A combustor for a gas turbine comprising: a combustor housing including a flow liner and a flow sleeve surrounding and spaced from said flow liner defining a flow path therebetween and arranged for flowing compressor discharge air generally in a first axial upstream direction, opposite a flow of combustion gases from the combustor, between said liner and said flow sleeve to at least one burner at an aft end of the combustor; and an inlet device within said flow sleeve for introducing additional air into the flow path, said inlet device configured to turn the additional air flowing into said inlet device in a radial flow direction to a parallel axial upstream direction and to introduce the additional air to the flow path in said first axial upstream direction to thereby eliminate cross flow between the additional air introduced through the inlet and air flowing along the flow path.

6. A combustor according to claim 5 wherein said inlet device includes an annular plenum within said flow sleeve, said flow sleeve having at least one radially-oriented hole for flowing the additional air into the plenum, said plenum including at least one axially-oriented exit aperture in communication with said plenum for directing the additional air from said plenum into the flow path substantially in said first axial direction.

7. A combustor according to claim 6 wherein said plenum is formed in part by a casing within the flow sleeve, and wherein said at least one radially-oriented hole comprises a plurality of radially-oriented holes circumferentially spaced about said flow sleeve, and further wherein said at least one axially-oriented aperture comprises a plurality of apertures facing in a generally downstream direction of the air flow along the flow path.

8. A combustor according to claim 7 wherein said plenum is bounded in part by a portion of said flow sleeve.

9. A combustor according to claim 7 including an impingement sleeve surrounding a transition piece and defining a passage therebetween for flowing air into a forward end of said flow path, said plenum being spaced radially outwardly of the air flowing into the flow path.

10. In a combustor for a gas turbine having a flow liner, a fuel burner adjacent an aft end of the liner and a flow sleeve surrounding and spaced from the liner defining a flow path for flowing air in a first axial upstream direction, opposite a flow of combustion gases from the combustor, to said burner at said aft end, a method of introducing additional air into the air flowing along the flow path comprising step of introducing the additional air in a radial direction into an inlet device, turning the radially-introduced additional air so as to flow in a second parallel axial upstream direction, and injecting the additional air directly into the flow path to join with the air flowing in said first axial upstream direction toward said fuel burner at said aft end to thereby prevent cross flow between said additional air and air flowing in said flow path.

11. A method according to claim 10 including providing a casing defining a plenum within the flow sleeve, supplying the additional air to the plenum, and directing the additional air from said plenum through apertures facing in the generally downstream and generally parallel to said first axial flow direction.

12. A method according to claim 11 including supplying the additional air to the plenum through the flow sleeve.

* * * * *

UNITED STATES PATENT AND TRADEMARK OFFICE

CERTIFICATE OF CORRECTION

PATENT NO. : 7,707,835 B2
APPLICATION NO. : 11/152234
DATED : May 4, 2010
INVENTOR(S) : Lipinski et al.

It is certified that error appears in the above-identified patent and that said Letters Patent is hereby corrected as shown below:

At Column 2, line 42, delete "transition including a transition section piece body" and insert --transition piece--.

Signed and Sealed this

Sixth Day of July, 2010

David J. Kappos

David J. Kappos
*Director of the United States Patent and Trademark Office*